US007490364B2

(12) United States Patent
Kim

(10) Patent No.: US 7,490,364 B2
(45) Date of Patent: Feb. 17, 2009

(54) FUNCTIONAL CAP

(76) Inventor: Leo Hipom Kim, 16034 Selborne Dr, San Leandro, CA (US) 94578

( * ) Notice: Subject to any disclaimer, the term of this patent is extended or adjusted under 35 U.S.C. 154(b) by 38 days.

(21) Appl. No.: 11/787,062

(22) Filed: Apr. 13, 2007

(65) Prior Publication Data

US 2008/0250544 A1 Oct. 16, 2008

(51) Int. Cl.
*A42B 1/24* (2006.01)

(52) U.S. Cl. ..... 2/209.13; 40/329

(58) Field of Classification Search ..... 2/209.13; 40/329, 586

See application file for complete search history.

(56) References Cited

U.S. PATENT DOCUMENTS 6,311,332 B1 * 11/2001 Lien ..... 2/209.13
6,477,714 B1 * 11/2002 Boatwright ..... 2/171
7,243,377 B2 * 7/2007 Ashy ..... 2/209.13

* cited by examiner

*Primary Examiner*—Katherine Moran

(57) ABSTRACT

The present invention relates to a functional cap that is provided with a holder adapted to be attached to a cap body, the holder having a given shape like a square, oval, round, and triangle, with a plurality of ventilating holes or without having any ventilating holes formed thereon, such that a plate having a character formed of a specific picture or letter is detachably mounted to the holder of the cap body. The plate of the present invention has a specific character recognized by naked eyes like a specific letter or picture formed on one surface thereof, and the plate can be detachably mounted to the holder by an external force applied by a wearer. Therefore, the functional cap of the present invention can be utilized for advertising specific organizations or groups when the plate is exchanged for their purpose. Thus, the functional cap of the present invention can have the specific picture on a famous sightseeing site printed on the plate thereof and also can have the specific character for sales promotion of all kinds of groups, organizations, and companies.

3 Claims, 8 Drawing Sheets

FUNCTIONAL CAP

BACKGROUND OF THE INVENTION

1. Field of the Invention

The present invention relates to a functional cap that is provided with a holder adapted to be attached to a cap body, the holder having a given shape like a square, oval, round, and triangle, with a plurality of ventilating holes or without having any ventilating hole formed thereon, such that a plate having a character formed of a specific picture or letter is detachably mounted to the holder of the cap body.

The holder of the present invention has two kinds, i.e., one having a back plate having the plurality of ventilating holes formed thereon and the other having no back plate. On the other hand, the holder has two kinds, i.e., one having fitting wings and the other having no fitting wings. Thus, the holder is coupled to the cap body by means of sewing or an adhesive.

The holder of the present invention can be used in a mounted relation with the plate or in a separated relation from the plate, in accordance with a wearer's demand.

The plate of the present invention has a specific character recognized by naked eyes like a specific letter or picture formed on one surface thereof, and the plate can be detachably mounted to the holder by an external force applied by a wearer. Therefore, the functional cap of the present invention can be utilized for advertising specific organizations or groups when the plate is exchanged for their purpose. Thus, the functional cap of the present invention can have the specific picture on a famous sightseeing site printed on the plate thereof and also can have the specific character for sales promotion of all kinds of groups, organizations, and companies.

2. Background of the Related Art

In general, a conventional cap has a plate sewn integrally on the front surface thereof, the plate having a specific character, letter or the like additionally provided on one surface thereof. Once the plate has been attached on the cap, it is actually difficult to exchange the plate with another plate, thereby undesirably causing many limitations in the variations of its function and design.

SUMMARY OF THE INVENTION

Accordingly, the present invention has been made in view of the above-mentioned problems occurring in the prior art, and it is an object of the present invention to provide a functional cap that is provided with a holder adapted to be attached to a cap body, the holder having a given shape like a square, oval, round, and triangle, with a plurality of ventilating holes or without having any ventilating holes formed thereon, such that a plate having a character formed of a specific picture or letter is detachably mounted to the holder of the cap body.

To accomplish the above object, according to the present invention, there is provided a functional cap including: a holder having a fitting groove formed along the inner edges thereof of the front side thereof, holder wings formed along the outside surface of the fitting groove, and a back plate formed on the bottom surface thereof, the back plate having wing grooves formed opened outwardly by a given depth, fitting wings formed on the outside of the wing grooves, and a plurality of ventilating holes formed thereon for allowing the heat generated from a wearer's skin at the inside of the cap body to be reduced by means of with external fresh air introduced therethrough; a cap body having a cap hole formed at a given position thereof, the cap hole having a cap section adapted to be fit into the wing grooves; and a plate detachably mounted to the holder, the plate having a specific picture, letter, or character printed on one surface thereof.

Most preferably, the holder of the present invention is attached on the front surface of the cap body.

If necessary, however, the holder may be attached at every position including the side, back, and upper surface of the cap body, and it may be appropriately varied in the shape in accordance with the attached positions. The functional cap of the present invention may form the cap hole on the cap body thereof or may not form the cap hole thereon, depending upon the structure of the holder, and the holder can be attached to the cap body by means of sewing or an adhesive.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1A:
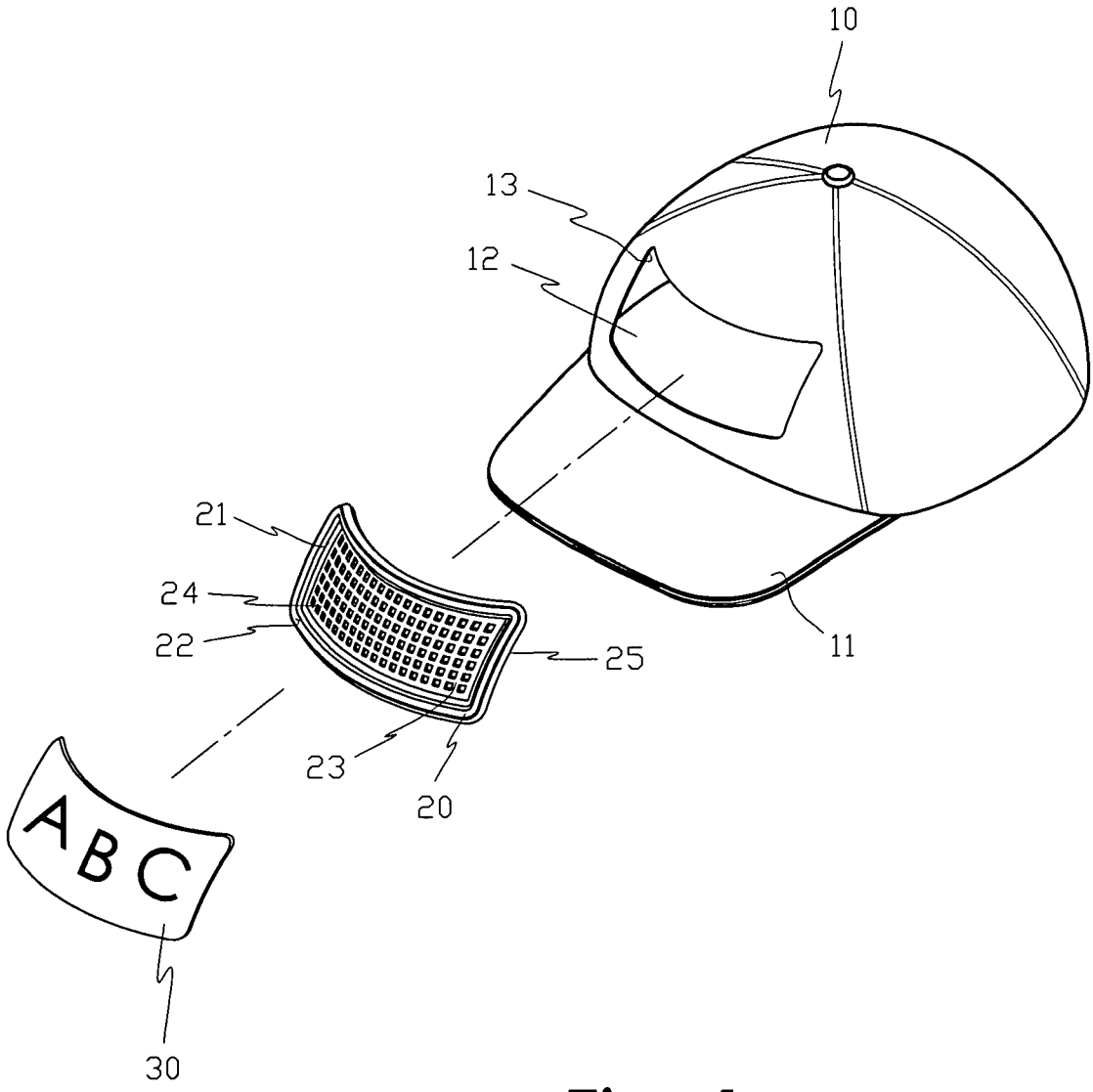
FIG. 1*a* is an exploded perspective view showing a functional cap according to a first embodiment of the present invention, wherein the functional cap is coupled with a holder having a plurality of ventilating holes formed thereon and with a plate having a character like specific letters printed thereon.
Figure 1B:
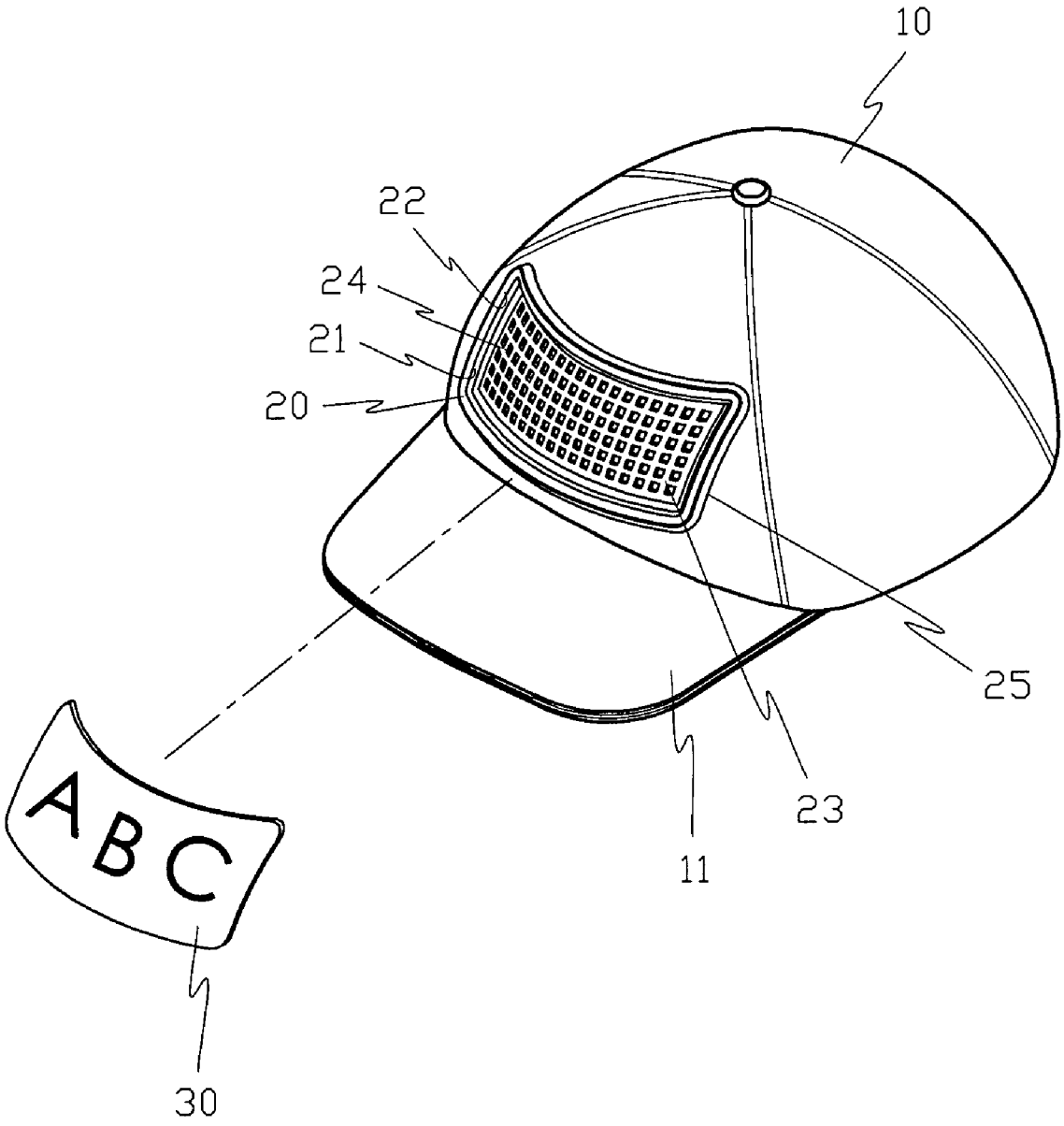
FIG. 1*b* is a perspective view showing the functional cap, wherein the holder having the plurality of ventilating holes is attached on a cap body and the plate is separated from the cap body.
Figure 1C:
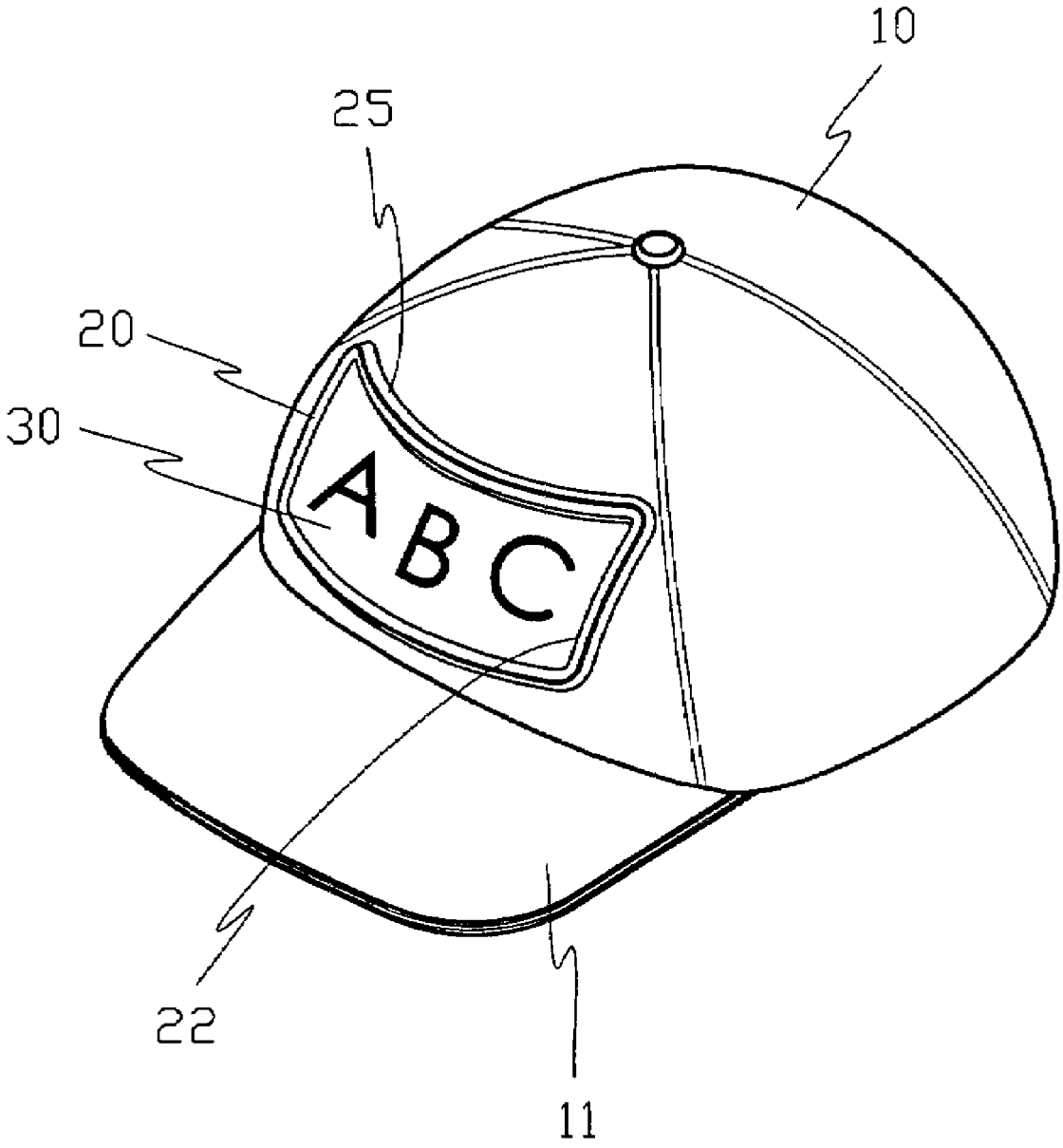
FIG. 1*c* is a perspective view showing the functional cap that is completely coupled with the plate separated in FIG. 1*b;*
Figure 2A:
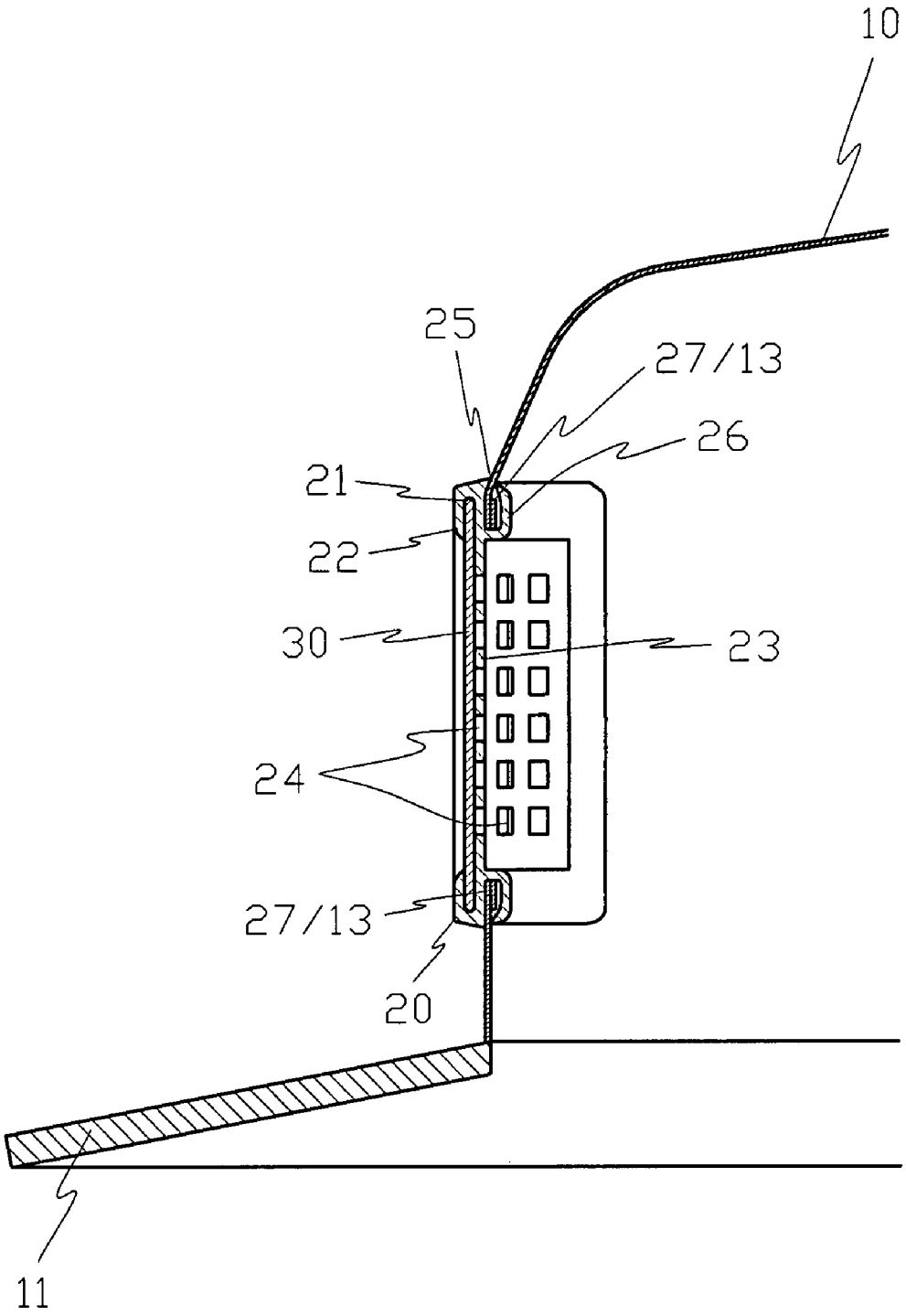
FIG. 2*a* is a sectional view showing the functional cap according to the first embodiment of the present invention.
Figure 2B:
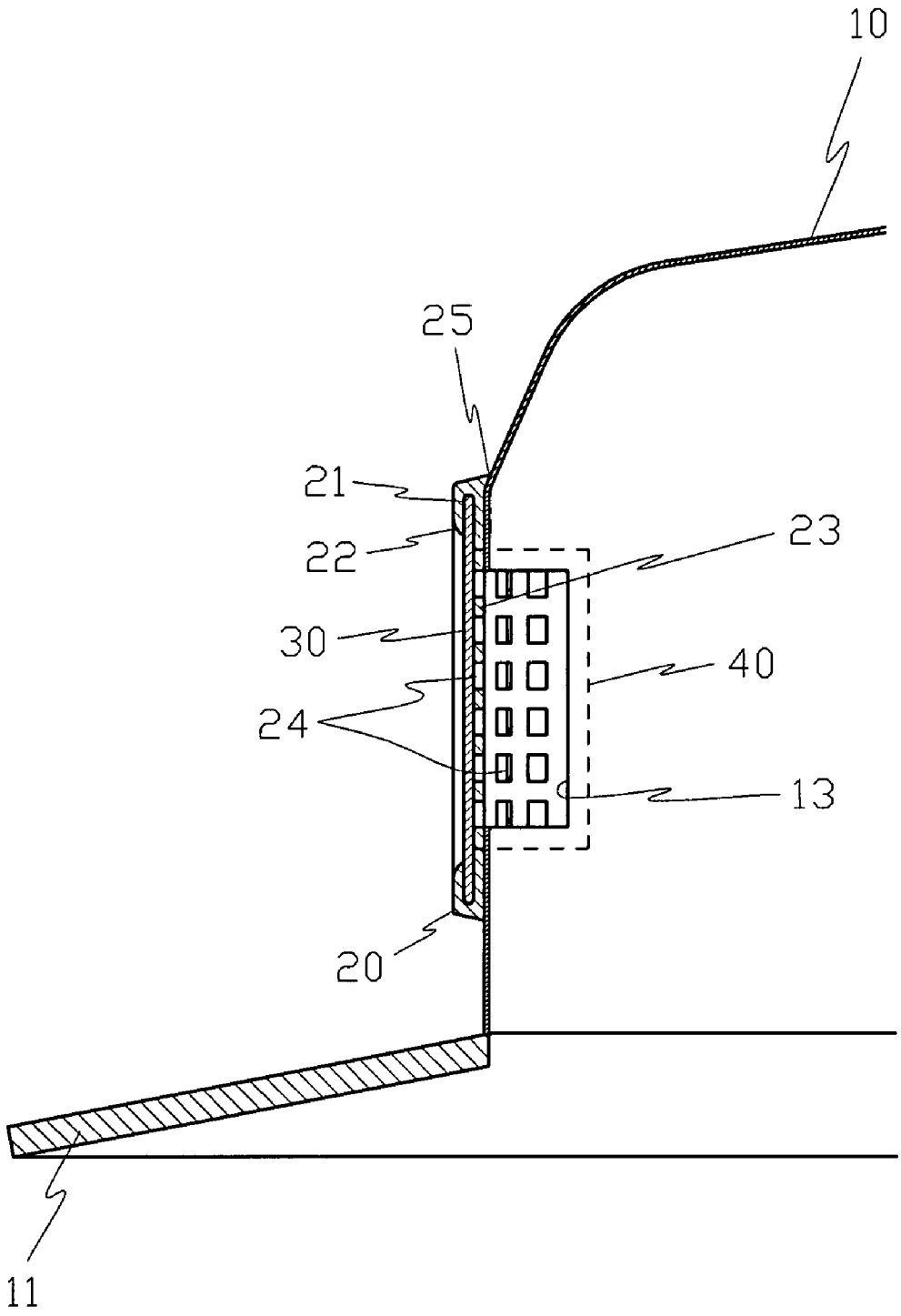
FIG. 2*b* is a sectional view showing the functional cap according to a second embodiment of the present invention.
Figure 3A:
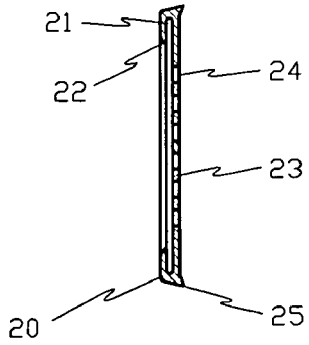
FIG. 3*a* is a sectional view showing the holder of the functional cap according to the second embodiment of the present invention.
Figure 3B:
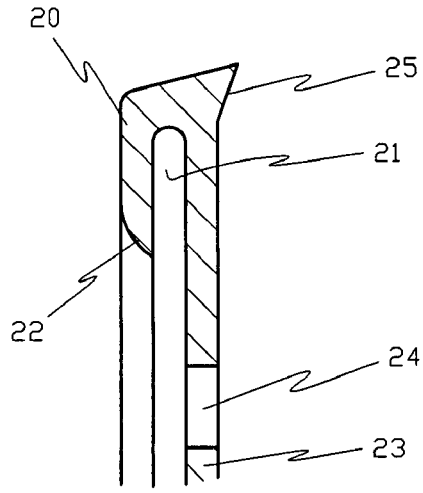
FIG. 3*b* is a partly enlarged sectional view of FIG. 3*a;*
Figure 4A:
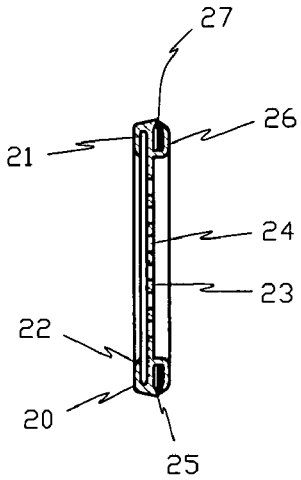
FIG. 4*a* is a sectional view showing the holder of the functional cap according to the first embodiment of the present invention.
Figure 4B:
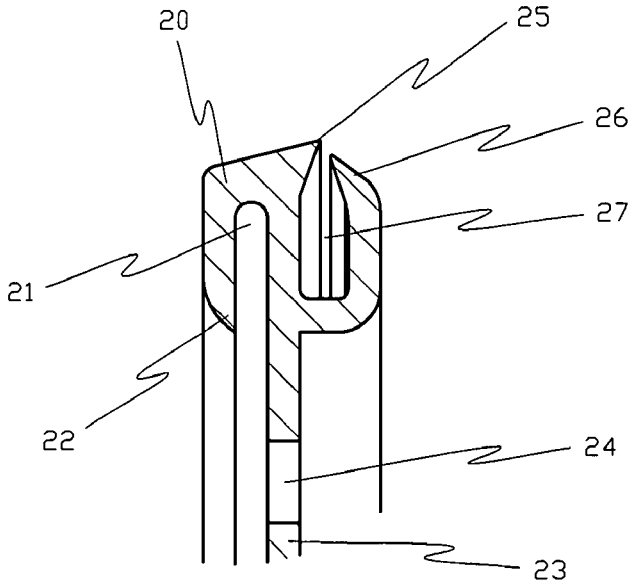
FIG. 4*b* is a partly enlarged sectional view of FIG. 4*a;*
Figure 5A:
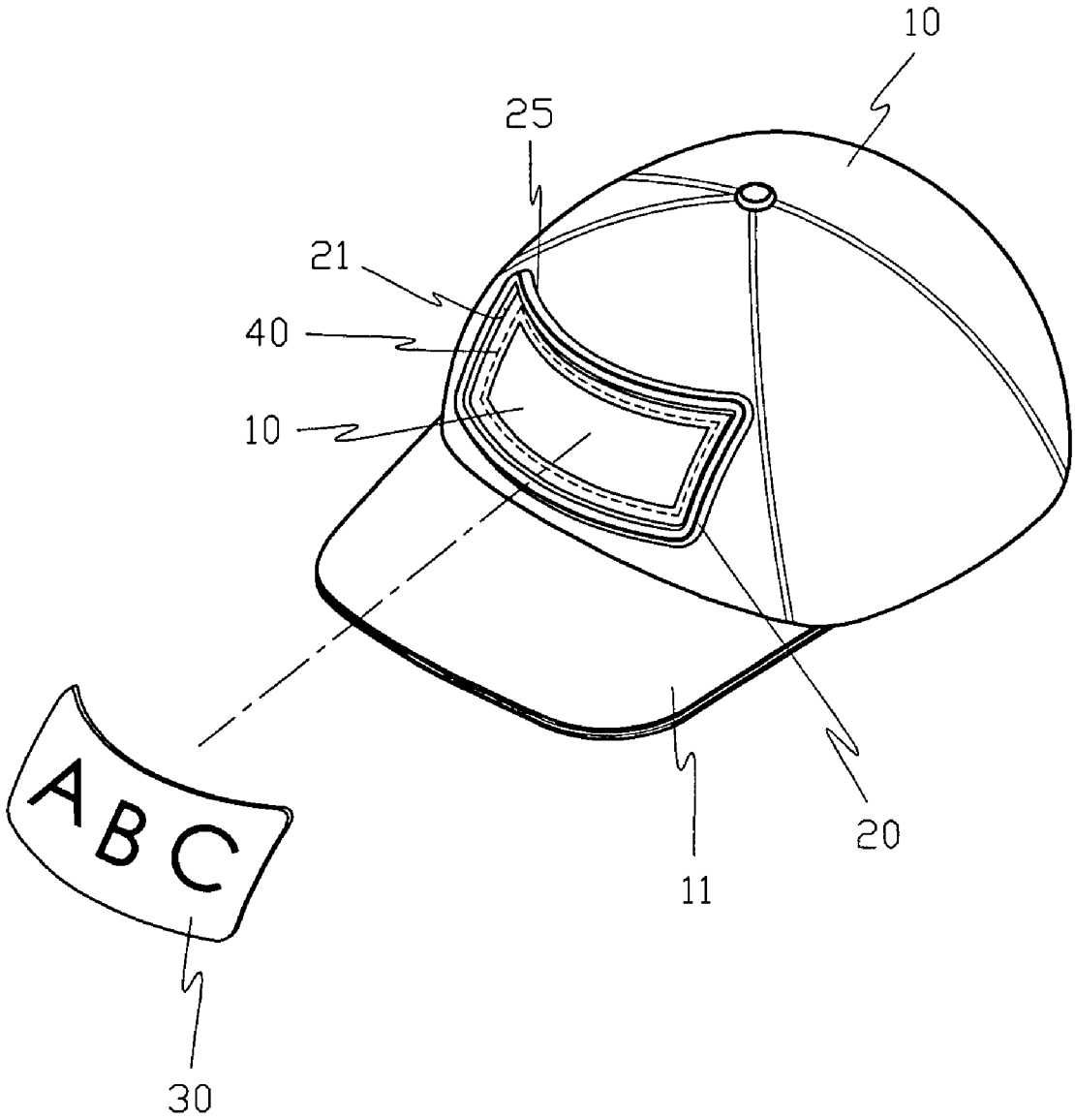
FIG. 5*a* is a perspective view showing a functional cap according to a third embodiment of the present invention.
Figure 5B:
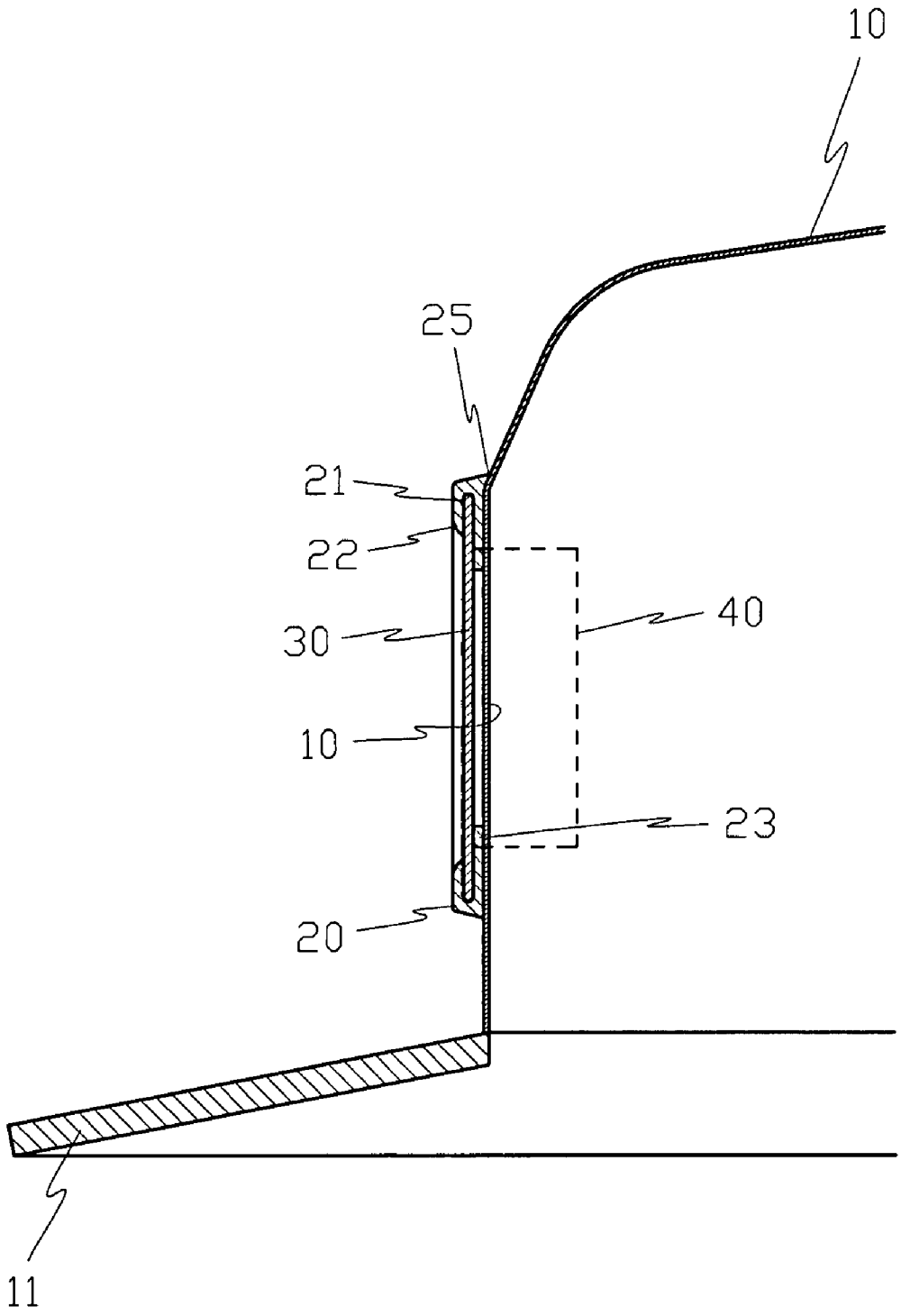
FIG. 5*b* is a sectional view of FIG. 5*a.*

FIG. 1*a* is an exploded perspective view showing a functional cap according to a first embodiment of the present invention, wherein the functional cap is coupled with a holder having a plurality of ventilating holes formed thereon and with a plate having a character like specific letters printed thereon, FIG. 1*b* is a perspective view showing the functional cap, wherein the holder having the plurality of ventilating holes is attached on a cap body and the plate is separated from the cap body; FIG. 1*c* is a perspective view showing the functional cap that is completely coupled with the plate separated in FIG. 1*b*; FIG. 2*a* is a sectional view showing the functional cap according to the first embodiment of the present invention; FIG. 2*b* is a sectional view showing the functional cap according to a second embodiment of the present invention; FIG. 3*a* is a sectional view showing the holder of the functional cap according to the second embodiment of the present invention; FIG. 3*b* is a partly enlarged sectional view of FIG. 3*a*; FIG. 4*a* is a sectional view showing the holder of the functional cap according to the first embodiment of the present invention; FIG. 4*b* is a partly enlarged sectional view of FIG. 4*a*; FIG. 5*a* is a perspective view showing a functional cap according to a third embodiment of the present invention; and FIG. 5*b* is a sectional view of FIG. 5*a*.

It is appreciated from the drawings that the functional cap of the present invention includes a cap body 10, a holder 20, and a plate 30. Hereinafter, an explanation of the functional cap according to the present invention will be given with reference to the attached drawings.

According to the preferred embodiments of the present invention, the cap body 10 does not have a cap hole 12 formed thereon, and otherwise, it has the cap hole 12 formed thereon. As shown in FIG. 1*a*, in a case where the cap body 10 has the cap hole 12, it is completely punched thereon to form the cap hole 12. At this time, a cap section 13 that is formed cut for the formation of the cap hole 12 is sewn at a finishing step thereof.

According to a first embodiment of the present invention, further, the holder 20 adapted to be attached to the cap hole 12 includes a back plate 23 having a plurality of ventilating holes 24 formed thereon and fitting wings 26 formed on the bottom surface thereof, as shown in FIGS. 2*a*, 4*a* and 4*b*.

According to a second embodiment of the present invention, further, the holder 20 adapted to be attached to the cap hole 12 includes the back plate 23 having the plurality of ventilating holes 24 formed thereon, without having any fitting wings 26 formed on the bottom surface thereof, as shown in FIGS. 2*b*, 3*a* and 3*b*.

According to a third embodiment of the present invention, further, the holder 20 adapted to be attached to the cap hole 12 includes the back plate 23, without having the plurality of ventilating holes 24 and the fitting wings 26 formed thereon, as shown in FIGS. 5*a* and 5*b*.

In addition to the first to third embodiments of the present invention, on the other hand, the holder 20 of the present invention may have different structures.

Especially, the holder 10 and the plate 10 of the functional cap according to the preferred embodiments of the present invention may have a triangular, rectangular, square, round, oval, and other shapes. Now, an explanation of the functional cap of the present invention will be in detail described.

FIG. 2*a* is a sectional view showing the functional cap according to the first embodiment of the present invention. At this time, the holder 20 includes: a fitting groove 21 formed along the inner edges thereof in a direction seen by naked eyes in such a manner as to be fittably coupled to the plate 30; holder wings 22 adapted to compress the edges of the plate 30 fit along the fitting groove 21; and the back plate 23 having the plurality of ventilating holes 24 adapted to allow the heat generated from a wearer's skin at the inside of the cap body 10 to be reduced by means of external fresh air introduced therethrough, the fitting wings 26 having wing grooves 27 adapted to fittably insert the cap section 23 thereinto, and contact wings 25 formed inclined drastically to one direction along the periphery thereof in such a manner as to make the cap body 10 and the holder 20 tightly abut each other. Then, the holder 20 is attached to the cap body 10, as shown in FIG. 2*a*.

A method for attaching the holder 20 to the cap body 10 includes the insertion of the cap section 13 into the wing grooves 27, after a predetermined quantity of adhesive is applied onto the wing grooves 27 and the cap section 13, such that the wing grooves 27 and the cap section 13 are not separated from each other.

At this time, the adhesive has a good bonding capability, and after it is melted by heat, if necessary, it can be applied thereto.

When the holder 20 is attached to the cap hole 12, the functional cap can have improved design effects and at the same time allow the heat generated from a wearer's skin at the inside of the cap body 10 to be reduced by means of external fresh air introduced through the plurality of ventilating holes 24, thereby effectively removing the wearer's unpleasant feeling and the heat generated at the inside of the cap during the wearing.

On the other hand, after the holder 20 is attached to the cap body 10, the plate 30 is mounted on the holder 20. After mounting, the plurality of ventilating holes 24 are closed such that the air circulation stops.

The plate 30 may be a patterned plate on which various pictures or letters are printed or may be a plain plate having no pictures or letters printed thereon. In the preferred embodiments of the present invention, the plate 30 is the patterned plate on which various pictures or letters are printed.

First, the plate 30 has a defined size capable of being inserted along the fitting groove 21 of the holder 20, and then, it has various pictures, characters, solid patterns, or letters printed on one surface thereof according to the demand of buyers. After that, the plate 30 is mounted on the holder 20 attached to the cap body 10.

According to a method for mounting the plate 30 on the holder 20, first, the holder wings 22 coupled to the cap body 10 are opened by using a tool having a flat end and at this time, the plate 30 is fit gradually to the fitting groove 21. In this case, the holder wings 22, which are formed of an elastic material like rubber, return to its original shape and compress the edges of the holder 20, thereby making the coupled state between the plate 30 and the holder 20 rigidly maintained. Thus, the coupled state of the plate 30 and the holder 20 is not released unless an arbitrary force is applied to the holder 20. If the plate 30 is to be detached from the holder 20 after coupling, however, in the reverse order to the coupling order as mentioned above, one holder wing 22 is opened to obtain a given space between the plate 30 and the holder 20, and after that, the plate 30 is pushed from the inside towards the outside and thus separated from the holder 20. This is based upon the first embodiment of the present invention.

Next, according to the second embodiment of the present invention, the fitting wings 26, which are provided in the first embodiment of the present invention, are removed therein, as shown in FIG. 2*b*.

According to the method for attaching the holder 20 to the cap body 10, as shown in FIG. 2*b*, at the state where the back plate 23 is placed on the outer surface of the cap body 10 it is sewn by means of a sewing means.

If the back plate 23 is sewn on the cap body 10, the contact wings 25 of the holder 25 are bent toward the cap body 10, such that the holder 20 and the cap body 10 are coupled in a tightly closing relation with each other.

Next, the plate 30 is mounted on the holder 20, and a method for mounting the plate 30 on the holder 20 is the same as mentioned in the first embodiment of the present invention.

If the plate 30 is mounted on the holder 20, a sewing line 40 is hidden by placing the plate 30 on the holder.

Further, according to the third embodiment of the present invention, the plurality of ventilating holes 24 and the back plate 23 having the plurality of ventilating holes 24 are all removed therein, unlike the second embodiment of the present invention.

In other words, according to the third embodiment of the present invention, the back plate 23 having the plurality of ventilating holes 24 is removed, and in this case, it is not completely removed therein. That is, the sewing line 40 between the holder 20 and the cap body 10 is formed larger than the holder wings 22 on the front surface of the holder 20, as shown in FIGS. 5*a* and 5*b*. The method for attaching the holder 20 to the cap body 10 is carried out by means of the application of an adhesive, and most preferably by means of the sewing line 40, as previously described above. And, the method for mounting the plate 30 to the holder 20 is carried out most usefully by their insertion and separation, as described above, but in some cases, the plate 30 may be mounted to the holder by means of magnets having given flexibility.

On the other hand, in attaching the holder 20 to the cap body 10, the cap body 10 has the cap hole 12 having the cap section 13 formed therealong at a place coupled with the holder 20 according to the first and second embodiments of the present invention, as shown in FIG. 1*a*. According to the third embodiment of the present invention, otherwise, the cap body 10 does not have any cap hole 12 formed thereon, as shown in FIG. 5*a*, and thus, the holder 20 is attached to the cap body 10 having no hole at the position coupled with the holder 20.

As set forth in the foregoing, there is provided a functional cap according to the preferred embodiments of the present invention can provide various designs, thereby overcoming the limitation of designs an object like caps has.

Functionally, the functional cap of the present invention can allow the heat generated by a wearer's skin at the inside of the cap body to be reduced by means of the external fresh air introduced through the plurality of ventilating holes of the holder, thereby making the wearer's skin healthy and clean.

More particularly, the functional cap of the present invention can have the plate detachably mounted to the holder, such that the plate serves as a door for opening and closing the plurality of ventilating holes and at the same time, the name or logo of a specific company, organization, or group is printed on the plate, thereby utilizing as the cap for effective sale promotion or advertisement.

Further, the functional cap of the present invention can have the plate printed with a given character indicating a specific meaning in famous sightseeing sites or amusement parks like Disney World or Disney land, thereby serving as excellent sightseeing goods.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A functional cap comprising:

a holder 20 having a fitting groove 21 formed along the inner edges thereof of the front side thereof, holder wings 22 formed along the outside surface of the fitting groove 21, and a back plate 23 formed on the bottom surface thereof, the back plate 23 having wing grooves 27 formed opened outwardly by a given depth, fitting wings 26 formed on the outside of the wing grooves 27, and a plurality of ventilating holes 24 formed thereon for allowing the heat generated from a wearer's skin at the inside of the cap body 10 to be reduced by means of with external fresh air introduced therethrough;

a cap body 10 having a cap hole 12 formed at a given position thereof, the cap hole 12 having a cap section 13 adapted to be fit into the wing grooves 27; and a plate 30 detachably mounted to the holder 20, the plate 30 having a specific picture, letter, or character printed on one surface thereof.

2. The functional cap according to claim 1, wherein the holder 20 comprises the fitting groove 21 formed along the inner edges of the front side thereof, the holder wings 22 formed along the outside surface of the fitting groove 21, and the back plate 23 having the plurality of ventilating holes 24 formed thereon for allowing the heat generated from a wearer's skin at the inside of the cap body 10 to be reduced by means of external fresh air introduced therethrough.

3. The functional cap according to claim 1, wherein the holder 20 comprises the fitting groove 21 formed along the inner edges of the front side thereof, the holder wings 22 formed along the outside surface of the fitting groove 21, and a back plate 23 formed slightly larger at a width thereof than the holder wings 22, such that the holder 20 is attached at a given position of the cap body 10 on which the cap hole is not formed.

* * * * *